US008132483B2

(12) United States Patent
Holland et al.

(10) Patent No.: US 8,132,483 B2
(45) Date of Patent: Mar. 13, 2012

(54) POSITIVE HANDLE STOP FOR SWITCHES

(75) Inventors: Michael J. Holland, Hilliard, OH (US); Eric Heskett, Springfield, OH (US); Thomas Jameson, Bellefontaine, OH (US); Patrick Logan, Tipp City, OH (US)

(73) Assignee: Siemens Industry, Inc., Alpharetta, GA (US)

( * ) Notice: Subject to any disclaimer, the term of this patent is extended or adjusted under 35 U.S.C. 154(b) by 314 days.

(21) Appl. No.: 12/204,175

(22) Filed: Sep. 4, 2008

(65) Prior Publication Data

US 2010/0005922 A1 Jan. 14, 2010

Related U.S. Application Data

(60) Provisional application No. 61/080,370, filed on Jul. 14, 2008.

(51) Int. Cl.
*G05G 5/06* (2006.01)

(52) U.S. Cl. ..... 74/526

(58) Field of Classification Search ..... 74/473.1, 74/473.3, 519, 522.5, 523, 526, 545; 200/252, 200/304, 327

See application file for complete search history.

(56) References Cited

U.S. PATENT DOCUMENTS

| | | | | | |
|---|---|---|---|---|---|
| 2,832,857 | A | * | 4/1958 | Landmeier | 200/43.19 |
| 3,109,899 | A | * | 11/1963 | Pastene | 200/43.19 |
| 3,572,152 | A | * | 3/1971 | Bruhn, Jr. et al. | 74/473.3 |
| 3,832,658 | A | * | 8/1974 | Hayden | 335/181 |
| 5,290,979 | A | * | 3/1994 | Grass | 200/43.19 |
| 5,412,167 | A | * | 5/1995 | Mueller et al. | 200/43.14 |

* cited by examiner

*Primary Examiner* — Vicky Johnson

(57) ABSTRACT

The present invention relates generally to handle stops. More particularly, the invention encompasses a positive handle stop for a switch. The positive handle stop for a switch, such as, a safety switch, prevents the handle of a switch from returning to the shipping position once the switch is turned ON. The invention also includes a shipping position for the inventive handle so as to reduce the size of the packaging need to ship the switch apparatus.

17 Claims, 3 Drawing Sheets

POSITIVE HANDLE STOP FOR SWITCHES

CROSS-REFERENCE TO RELATED APPLICATION

The instant patent application is related to U.S. Provisional Patent Application Ser. No. 61/080,370, filed on Jul. 14, 2008, titled "Positive Handle Stop For Switches," the disclosure of which is incorporated herein by reference.

FIELD OF THE INVENTION

The present invention relates generally to handle stops. More particularly, the invention encompasses a positive handle stop for a switch. The positive handle stop for a switch, such as, a safety switch, prevents the handle of a switch from returning to the shipping position once the switch is turned ON. The invention also includes a shipping position for the inventive handle so as to reduce the size of the packaging need to ship the switch apparatus.

BACKGROUND INFORMATION

A positive handle stop provides a mechanical stop for a handle to engage in when going from an ON-position to an OFF-position.

For most all applications handles for safety switches are designed to prevent the switch operator's hands from being injured when operating the safety switch. In order to prevent injury the handle must protrude past the enclosure cover in the ON-position and also in the OFF-positions. Since the handle protrudes past the cover the shipping carton must be enlarged to accommodate the handle protrusion and which in turn increases the carton, packaging and shipping costs.

Currently the handle guard, such as, one provide by Siemens Corporation, is located on the outside of the handle and provides a positive stop for the ON, OFF, and the shipping position of the safety switch. The stop for the OFF-position is a metal protrusion formed in the handle guard. In order to place the switch in the shipping position the handle must be forced to the side of the handle guard protrusion slightly deforming the handle. Once the handle is moved past the stop to the ON-position it returns to its' original form. Other manufacturers in the industry either do not provide a shipping position for their safety switches or a positive-type stop for their handles for their safety switches.

Another problem with having the handle guard protrusion as the positive stop is that after repeated use the handle will wear the stop down allowing the handle to move past the OFF-position. The switch has a provision for locking in the OFF-position by placing a lock through an opening in the handle and handle guard. If the handle is moved past the OFF-position it may be possible to place a lock in the handle guard only and not the handle allowing an operator to turn the switch ON with the lock installed.

Thus, a need exists for an improved positive handle stop for safety switches.

This invention overcomes the problems of the prior art and provides an inventive positive handle stop for switches.

PURPOSES AND SUMMARY OF THE INVENTION

The invention is a novel positive handle stop for switches.

Therefore, one purpose of this invention is to provide a novel positive handle stop for switches.

Another purpose of this invention is to provide a positive handle stop for a switch which prevents a handle of the switch from returning to the shipping position once the switch is turned ON.

Yet another purpose of this invention is to provide a positive handle stop for a switch which has a shipping position and an operational position.

Still yet another purpose of this invention is to provide a positive handle stop for a switch which has a shipping position to reduce the size of the shipping package.

Therefore, one aspect this invention comprises a handle stop for a switching apparatus, comprising:

(a) at least one handle guard, wherein a first end of said handle guard and a second end of said handle guard are secured to a switching apparatus, and wherein said handle guard has an open area between said first end and said second end;

(b) at least one handle stop, wherein said handle stop is inside said open area of said handle guard, and wherein said handle stop has a first end and a second end, and wherein said first end of said handle stop is secured to an inner portion of said handle guard and said second end of said handle stop has at least one securing means which rests against an inner face of said handle guard in a first position and protrudes through a first opening in said handle guard in a second position; and (c) a handle, wherein said handle is inside said open area of said handle guard, and wherein said handle has a first end and a second end, and wherein said first end of said handle is secured to said switching apparatus and said second end slides against said handle stop in a first position, and rests against said handle stop in a second position, thereby forming said handle stop for a switching apparatus.

BRIEF DESCRIPTION OF THE DRAWINGS

The features of the invention that are novel and the elements characteristic of the invention are set forth with particularity in the appended claims. The drawings are for illustration purposes only and are not drawn to scale. Furthermore, like numbers represent like features in the drawings. The invention itself, both as to organization and method of operation, may best be understood by reference to the detailed description which follows taken in conjunction with the accompanying drawings in which:

DETAILED DESCRIPTION

The positive handle stop of the present invention provides a novel mechanical stop for the handle to engage when going from the ON to the OFF position or to the shipping position.

As stated earlier, the positive handle stop eliminates the problems of the prior art. The positive handle stop is typically displaced or positioned using a screwdriver or a pair of pliers, which allows the handle to move or be moved into the shipping position. Once the handle is moved to the OFF-position or an ON-position the positive handle stop springs back into place. The positive handle stop incorporates a hook feature that can be locked into the handle guard. When the handle is moved to the OFF-position it will cause the hook feature to lock into the handle guard locking the positive handle stop in place.

Figure 1:
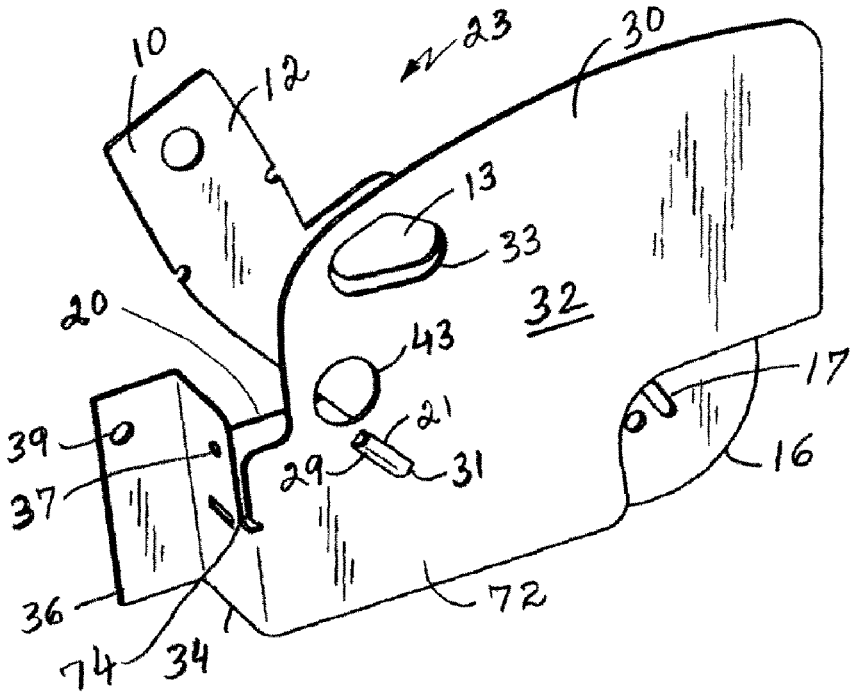
FIG. 1 is an outside perspective view of an exemplary switch apparatus having a positive handle stop for a safety switch which is used to illustrate an embodiment of the present invention.
Figure 2:
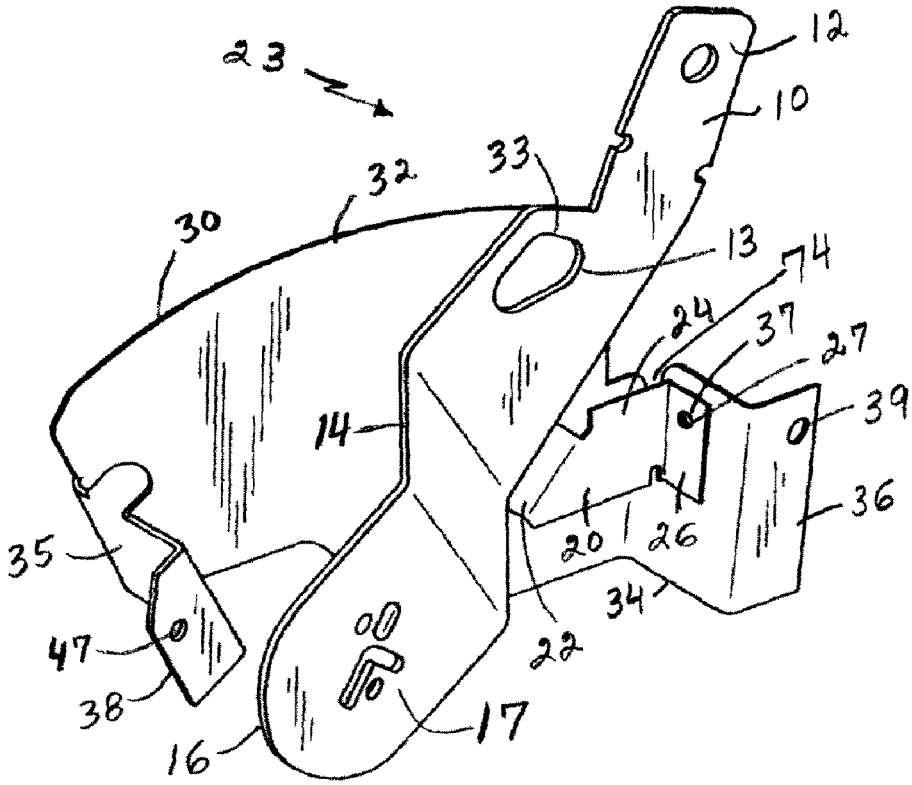
FIG. 2 is an enlarged inside view showing the handle along with the inventive handle stop and the handle guard.

Referring to FIGS. 1 through 6, taken together, FIG. 1 is an outside perspective view of an exemplary switch apparatus 23, having a positive handle stop 20, such as, for a safety switch 23, which is used to illustrate an embodiment of the present invention. While, FIG. 2 is an enlarged inside view showing the handle 10, along with the inventive handle stop 20, and the handle guard 30. The switch apparatus 23, has at least one handle 10, having an upper portion 12, a bent portion 14 and a bottom portion 16. The upper portion 12, has at least one hole or opening 13. The bottom portion 16, has at least one hole or opening 17. The switch apparatus 23, has at least one handle stop 20, where the handle stop 20, has a first portion 22, a second portion 24, and a third portion 26. The first portion 22, has at least one tab or protrusion 21, and the third portion 26, has at least one securing location 27. The switch apparatus 23, has at least one handle guard 30, to couple with and to protect the handle 10, and the handle stop 20. The handle guard 30, has a face or a first portion 32, a first bent portion 34, a first securing portion 36, a second bent portion 35, and a second securing portion 38. The first bent portion 34, has at least one securing location 37, and the first securing portion 36, has at least one opening or securing location 39. The second securing portion 38, has at least one opening or securing location 47. The face or first portion 32, has at least one first opening or securing location 31, and at least one second opening or securing location 33, and optionally at least one third opening or securing location 43. The securing means 21, of the handle stop 20, is preferably inserted through the opening 31, and secures the handle stop 20, to the handle guard 30. The handle stop 20, is also secured to the handle guard 30, using the securing location 27, and the securing location 37.

The securing means 21, of the inventive handle stop 20, preferably has a flexible bent portion 29, such as a hairpin type bent portion 29, or so that when the securing means 21, is inserted inside the hole or opening 31, the flexible bent portion 29, can pass through the opening 31, and an end portion of the flexible bent portion 29, can lodge itself against an outer face or surface 72, of the handle guard 30. For some applications the bent portion 29, could be a separate piece that is secured to the end of the securing means 21, so as to form a T-junction or a L-junction. It is preferred that during operation of the apparatus 23, the bent portion 29, which is preferably arcuate or arched so that an end portion of the bent portion 29, rests against the outer surface 72, of the handle guard 30, like an end of a bow. It should be appreciated that during shipping of the apparatus 23, the securing means 21, along with the flexible bent portion 29, are pushed back through the hole or opening 31, by means of a screw-driver or a pair of pliers and the flexible bent portion 29, rest against the opening 31, but on an inside face or surface, of the handle 12. It should be appreciated that the end of the securing means 21, of the positive handle stop 20, rests against the handle 10, in the shipping position, such that a portion of the handle 10, is inside a portion of an opening or slot 74, in the handle guard 30.

Figure 3:
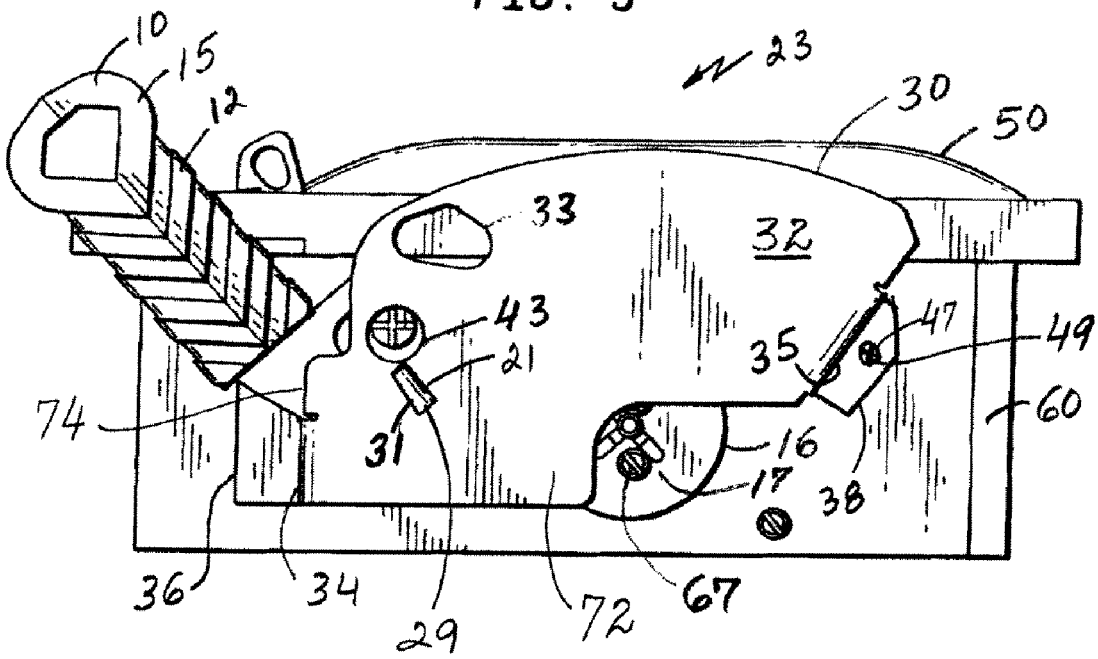
FIG. 3 is an outside view of the inventive positive handle stop with the cover and the enclosure showing the inventive handle in a shipping position.

FIG. 3 is an outside view of the inventive positive handle stop 20, with the cover 50, and the enclosure 60, showing the inventive handle 10, in a shipping position. The handle 10, can also have a sleeve or a handle cover 15. At least one securing means 67, such as, a bolt 67, or a screw 67, secure the handle 10, to the enclosure 60, at hole or opening 17. It is preferred that when the apparatus 23, is prepared for shipping, the handle 10, is moved to a position which is below a plane of an enclosure cover 50, of the switching apparatus 23. However, for some applications it may be preferred to have a substantial portion of the handle 10, below a plane of the enclosure cover 50, during the shipping process of the switching apparatus 23.

Figure 4:
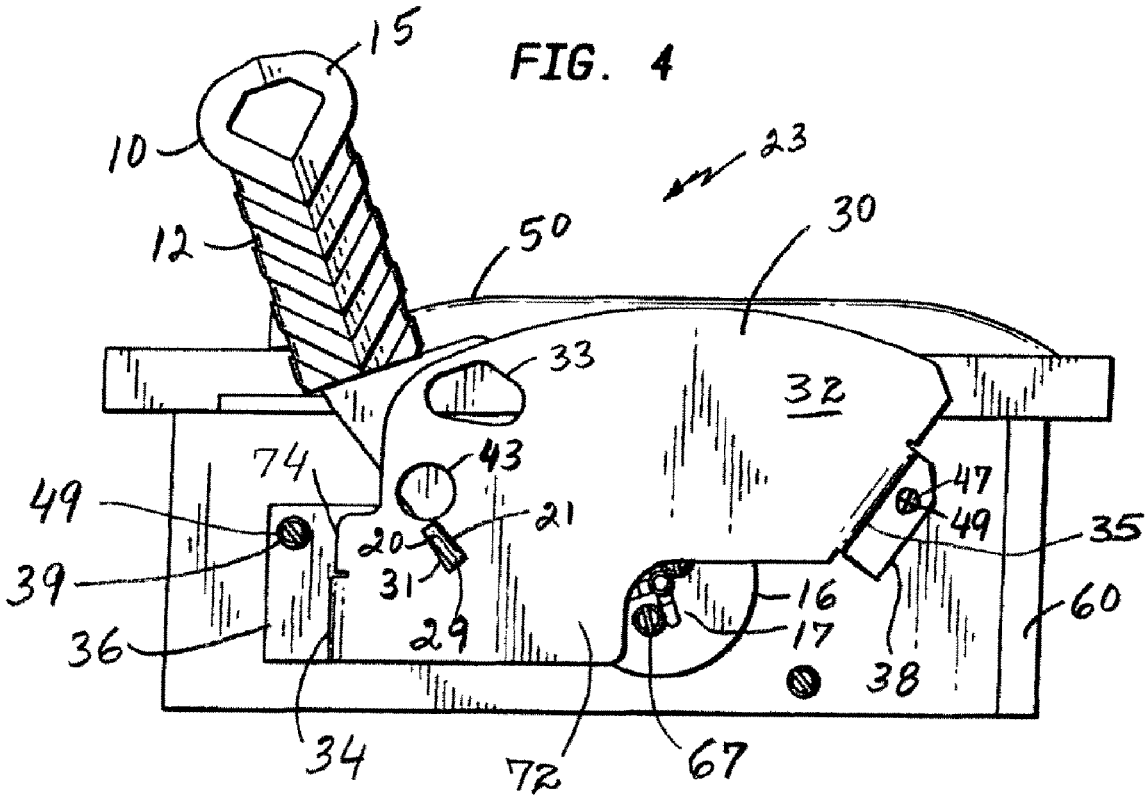
FIG. 4 is an outside view of the inventive positive handle stop with the cover and the enclosure showing the inventive handle in an OFF-position.

FIG. 4 is an outside view of the inventive positive handle stop 20, with the cover 50, and the enclosure 60, showing the inventive handle 10, in an OFF-position. At least two securing means 49, such as, a bolt 49, or a screw 49, secures the handle guard 30, to the enclosure 60, at the openings or securing locations 39 and 47.

Figure 5:
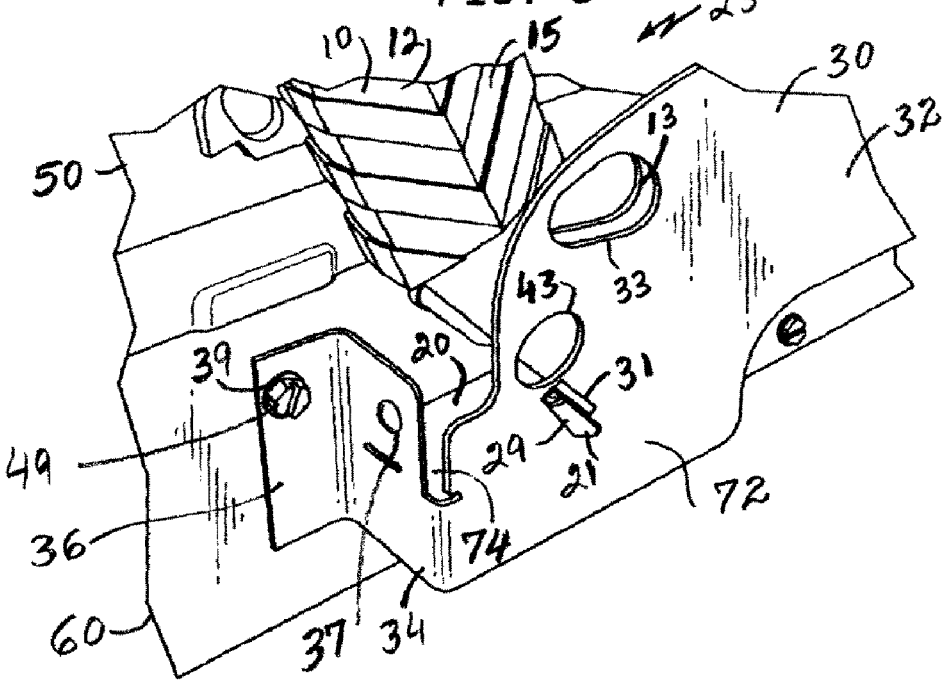
FIG. 5 is an enlarged perspective view of the inventive positive handle stop while viewing from an OFF-position of the inventive handle.

FIG. 5 is an enlarged perspective view of the inventive positive handle stop 20, while viewing from an OFF-position of the inventive handle 10. As one can see that in the OFF-position the hole or opening 13, in the handle 10, is aligned with the hole or opening 33, in the handle guard 30, such that a lock (not shown) can be used to prevent or limit or stop the movement of the handle 10, relative to the handle guard 30, that is fixedly secured to the enclosure 60. One can also see that the bottom of the upper portion 12, of the handle 10, is in contact with, or rests on, the first portion 22, of the handle stop 20, and the positive handle stop 20, prevents the movement or sliding of the handle 10, towards the securing location 27, 37, as more clearly seen when FIG. 2 and FIG. 5, are viewed together.

Figure 6:
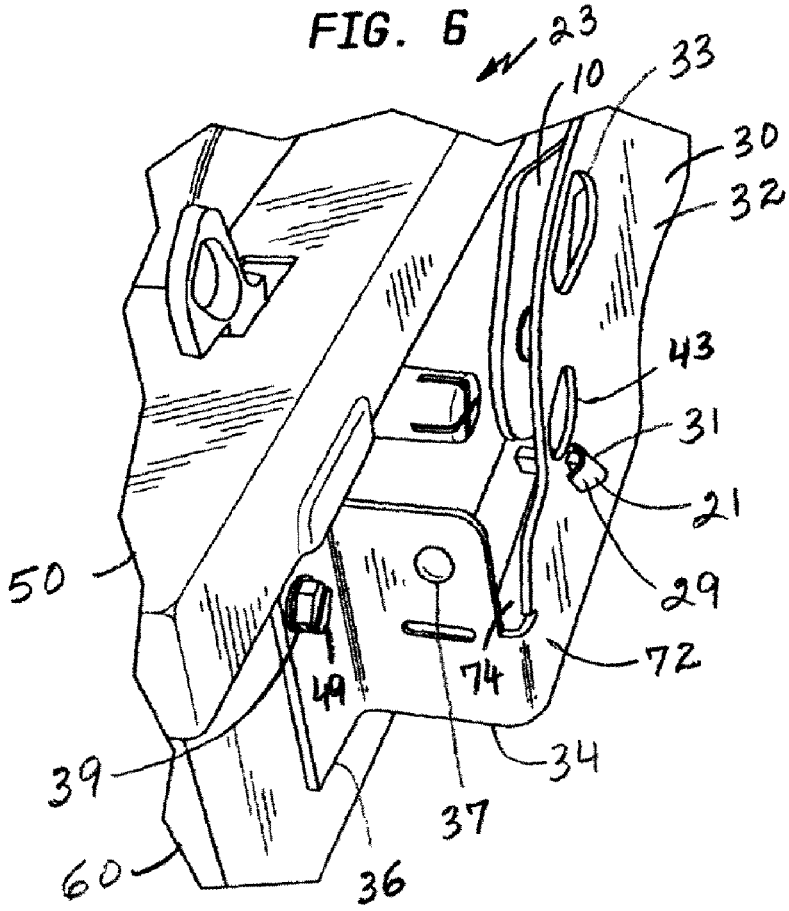
FIG. 6 is an enlarged perspective view of the inventive positive handle stop while viewing from an ON-position of the inventive handle.

FIG. 6 is an enlarged perspective view of the inventive positive handle stop 20, while viewing from an ON-position of the inventive handle 10. As one can see that in the operational or ON-position of the apparatus 23, the flexible bent portion 29, of the securing means 21, has been popped through the opening 31, and the end of the flexible bent portion 29, rests on the outer face surface 72, of the handle guard 30. Additionally, in the ON-position the handle 10, is moved away from the first portion 22, of the handle stop 20, and is positioned closer to the second bent portion 35, of the handle guard 30, as more clearly seen when FIG. 2 and FIG. 6, are viewed together.

The sleeve or a handle cover 15, is preferably made of an electrically insulating material, wherein the electrically insulating material is selected from a group comprising, Teflon, nylon, plastic, composite material, and combination thereof, to name a few.

The hole or opening 31, in the handle guard 30, to accommodate the securing means 21, is preferably selected from a group comprising, trapezoidal hole, square hole, rectangular hole, elliptical hole, triangular hole, and combination thereof, to name a few.

The securing means 21, along with the flexible bent portion 29, is preferably made from material selected from a group comprising, stainless steel, steel, metallic material, plastic, rubber, composite, and combination thereof, to name a few.

In order to eliminate the extra packaging cost the inventive handle 10, of this invention is placed in a shipping position. In the shipping position the inventive handle 10, of this invention is moved past the OFF-position allowing the inventive handle 10, to drop below the plane of the enclosure cover 50, or at least be substantially in the same plane as the plane of the enclosure cover 50.

The safety switch 23, preferably also has a provision for locking in the OFF-position, which can be done by placing a lock (not shown) through openings 13 and 33, in the handle 10, and handle guard 30, respectively. If the handle 10, if moved past the OFF-position it may be possible to place a lock (not shown) in the handle guard 30, only and not on the handle 10, thus allowing an operator to turn the switch ON with the lock (not shown) still installed in the opening 33, of the handle guard 30.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A handle stop for a switching apparatus including a handle moveable between first and second handle positions, comprising:

(a) at least one handle guard, wherein a first end of said handle guard and a second end of said handle guard are secured to a switching apparatus, and wherein said handle guard has an open area between said first end and said second end wherein said handle is located inside said open area; and (b) at least one blocking element inside said open area of said handle guard, wherein said blocking element has a first end and a second end, and wherein said first end of said blocking element is secured to an inner portion of said handle guard and said second end of said blocking element has at least one securing means which rests against an inner face of said handle guard in a first position in which said securing means is able to move to a second position wherein said securing means protrudes through a first opening in said handle guard to move said blocking element into a blocking position for blocking movement of said handle from said first handle position to said second handle position and wherein said handle has a first opening and said handle guard has a second opening, wherein at least a portion of said first opening in said handle overlaps at least a portion of said second opening in said handle guard when said handle is moved to a locking position.

2. The handle stop for a switching apparatus of claim 1, wherein at least one sleeve covers at least a portion of said handle.

3. The handle stop for a switching apparatus of claim wherein at least one sleeve made from an electrically insulating material covers at least a portion of said handle.

4. The handle stop for a switching apparatus of claim 1, wherein said electrically insulating material is selected from a group consisting of Teflon, nylon, plastic, composite material, and combination thereof.

5. The handle stop for a switching apparatus of claim 1, wherein said first opening in said handle guard to accommodate said at least one securing means of said-blocking element is selected from a group consisting of trapezoidal opening, square opening, rectangular opening, elliptical opening, triangular opening, and combination thereof.

6. The handle stop for a switching apparatus of claim 1, wherein said securing means has at least one flexible bent portion.

7. The handle stop for a switching apparatus of claim 1, wherein said securing means has at least one flexible bent portion which is T-shaped.

8. The handle stop for a switching apparatus of claim 1, wherein said securing means has at least one flexible bent portion, and wherein material for said flexible bent portion is selected from a group consisting of stainless steel, steel, metallic material, plastic, rubber, composite, and combination thereof.

9. The handle stop for a switching apparatus of claim 1, wherein said handle is moved to a shipping position, and wherein said shipping position is a position where said handle is below a plane of an enclosure cover for said switching apparatus.

10. The handle stop for a switching apparatus of claim 1, wherein said handle is moved to a shipping position, and wherein said shipping position is a position where a substantial portion of said handle is below a plane of an enclosure cover for said switching apparatus.

11. A handle stop for a switching apparatus including a handle which is moveable between first and second handle positions, comprising:

a handle guard having first and second ends attached to the switch apparatus wherein the first and second ends form a space for accommodating the handle; and a first member having first and second member ends wherein the first member end is attached to the handle guard and the second member end includes securing means moveable between a first member position wherein the securing means is not attached to the handle guard when the handle is in the first handle position and a second member position wherein the securing means protrude through an attachment opening in the handle guard and is attached to the handle guard when the handle is in the second handle position to stop movement of the handle from the second handle position to the first handle position and wherein the handle has a first opening and the handle guard has a second opening, wherein at least a portion of the first opening in the handle overlaps at least a portion of the second opening in the handle guard when the handle is moved to a locking position.

12. The handle stop according to claim 11, wherein the attachment opening is selected from a group consisting of trapezoidal opening, square opening, rectangular opening, elliptical opening, triangular opening, and combination thereof.

13. The handle stop according to claim 11, wherein the securing means has at least one flexible bent portion.

14. The handle stop according to claim 11, wherein the securing means has at least one flexible bent portion which is T-shaped.

15. The handle stop according to claim 11, wherein the securing means has at least one flexible bent portion, and wherein material for the flexible bent portion is selected from a group consisting of stainless steel, steel, metallic material, plastic, rubber, composite, and combination thereof.

16. The handle stop according to claim 11, wherein the handle is moved to a shipping position, and wherein the shipping position is a position where the handle is below a plane of an enclosure cover for the switching apparatus.

17. The handle stop according to claim 11, wherein the handle is moved to a shipping position, and wherein the shipping position is a position where a substantial portion of the handle is below a plane of an enclosure cover for the switching apparatus.

* * * * *